US005625932A

United States Patent [19]

Catallo

[11] Patent Number: 5,625,932

[45] Date of Patent: May 6, 1997

[54] APPARATUS FOR OPENING A TUBE OF KNITTED FABRIC

[76] Inventor: Frank Catallo, 84 Wheatley Rd., Old Westbury, N.Y. 11568

[21] Appl. No.: 349,800

[22] Filed: Dec. 6, 1994

[51] Int. Cl.[6] ..... D06C 5/00

[52] U.S. Cl. ..... 26/82; 26/85

[58] Field of Search ..... 26/80, 82, 84, 26/85, 83, 7, 8 C, 17; 83/175, 365, 367, 368

[56] References Cited

U.S. PATENT DOCUMENTS

| | | | |
|---|---|---|---|
| 3,238,282 | 3/1966 | Adams | 26/82 |
| 3,266,460 | 8/1966 | Brook | 26/82 |
| 3,381,397 | 5/1968 | Cohn et al. | 26/82 |
| 3,401,584 | 9/1968 | Cohn et al. | 26/82 |
| 3,492,705 | 2/1970 | McDonald | 26/82 |
| 3,776,077 | 12/1973 | Letsche | 26/82 |
| 3,864,794 | 2/1975 | Baumann | 26/82 |
| 3,893,213 | 7/1975 | Rockman et al. | 26/82 |

*Primary Examiner*—Amy B. Vanatta
*Attorney, Agent, or Firm*—Leo Fornero

[57] ABSTRACT

An apparatus for cutting or opening a tube of knit fabric is disclosed and includes a conveyor which moves the fabric along a horizontal axis as it enters the apparatus and continues in this horizontal path and the fabric is expanded cut and moved out of the apparatus along the horizontal axis.

8 Claims, 3 Drawing Sheets

APPARATUS FOR OPENING A TUBE OF KNITTED FABRIC

BACKGROUND OF THE INVENTION

It is normal to manufacture knit fabrics on circular knitting machines to thereby produce a continuous knit tube of fabric to be finished as necessary for the end user.

However it is at times desirable to open the tube and utilize the opened knit fabric in many instances. For example flat or open width knit fabric is useful in the case where printed fabrics are required and also where laminated and coated fabrics are to be the end products.

In certain instances a guide line is created in the fabric so that a sensing device can be disposed to follow the guide to present the fabric to a slitter or cutting member whereby the knit tube is continuously cut and may then be laid open so that the vertical wales of the knit tube of fabric are square or at right angles to the courses of the knit fabric. At other times it is more beneficial to slit or cut the knit tube at random disregarding the squareness of the wales to the courses.

As is known knitted fabric is easily deformed and is normally subject to internal stresses in the stitches of the yarn. This is particularly evident during the slitting of a knit tube of fabric as it is being moved before during and after the slitting procedure wherein drag on the tube causes tension in the fabric which in turn causes greater shrinkage in the products made from the open or flat fabric.

To improve the effectiveness of such slitting devices usually more consideration is given to the speed of cutting rather then to the creation of an end product that is cut efficiently but at the same time with minimized tension of the fabric to end up with lesser shrinkage potential.

Increased cutting speed resulted from the development of a cage like member with a sensing means and knife incorporated into the unit as integral parts which facilitated the flow of the knit fabric tube over the cage so that it was more easily opened and at the same time presented the fabric for cutting. Such an arrangement is shown in U.S. Pat. No. 3,864,794 to Baumann.

The Baumann concept has been incorporated by Bianco s.p.a. Localita Vaccheria, 7/2; 12051 Alba (C/N) Italy in a slitter which operates to provide knit fabric in tube form from a station to a squeezer. The fabric tube moves upwardly to a detwister and then downwardly to a cage which is disposed to receive the tube of fabric along a substantially vertical axis thereof. The fabric which has been cut may then be moved to another station. The slitter is shown in the Bianco s.p.a. undated catalog N. 5.

While the Bianco apparatus may be effective in slitting on a guide line at high speed it induces an abnormal amount of tension in the fabric. In order for the sensing device to track properly the cage has to be expanded to keep the fabric flat and free of wrinkles and a uniform distance away from the sensing head which follows the cutting guide on the fabric.

The draw roll that pulls the fabric over the cage tends to contact the fabric tube causing more drag and longitudinal tension to cause elongation of the fabric which is undesirable as shrinkage potential is higher.

OBJECTS OF THE INVENTION

To reduce this undesirable elongation and the objections it creates in the fabric I have devised an apparatus which accomplishes this objective without loosing the benefit of the higher slitting speeds demanded by fabric finishers.

It is therefore an object of this invention to provide a slitter apparatus that is capable of operating at the higher speeds needed by users thereof and at the same time one that does not induce higher shrinkage properties in the fabric.

It is another object to provide a slitter apparatus that is easy to operate and is also inexpensive to manufacture.

These and other objects and advantages of the present invention will become evident from the description which follows.

SUMMARY OF THE INVENTION

The concept disclosed herein permits slitting at high speeds and without the tension imparted to the fabric generated by most systems and this is achieved by running the knit fabric tube through the apparatus along a horizontal axis from the time the fabric enters the device and as it passes through the unit until it leaves the slitter unit. At the same time the cage which functions to open the knit tube of fabric is adjusted either manually or automatically to open the fabric but less then the diameter of the tube of knit fabric as it is supported by the cage.

In this manner the important benefit of reduced tension on the yams of the knit tube are achieved. That is, by running the fabric along a horizontal axis of the apparatus and minimizing the stretch of the fabric by the cage which is applied in Bianco in its fully open position and in the same position in U.S. Pat. No. 3,864,794.

In operation the weight of the fabric running along a horizontal axis is supported by the cage making it unnecessary that the fabric be expanded to the full diameter of the knit tube as is the case in the art mentioned above whereas in the apparatus shown herein the weight of the fabric tube is supported by the cage and this is sufficient to permit the fabric to be shifted to track the guide on the fabric. Since the support of the fabric tube is devised to occur close to the sensing device and the slitting knife you are provided with an apparatus that achieves the higher speed opening of the knit tube without the tensioning of the yarns as above described.

BRIEF DESCRIPTION OF THE DRAWINGS

In the accompanying drawings the objects and features of the apparatus contemplated herein become more readily apparent when taken in conjunction with said drawings in which like parts are designated with like characters and in which.

DESCRIPTION OF THE INVENTION

Figure 1:
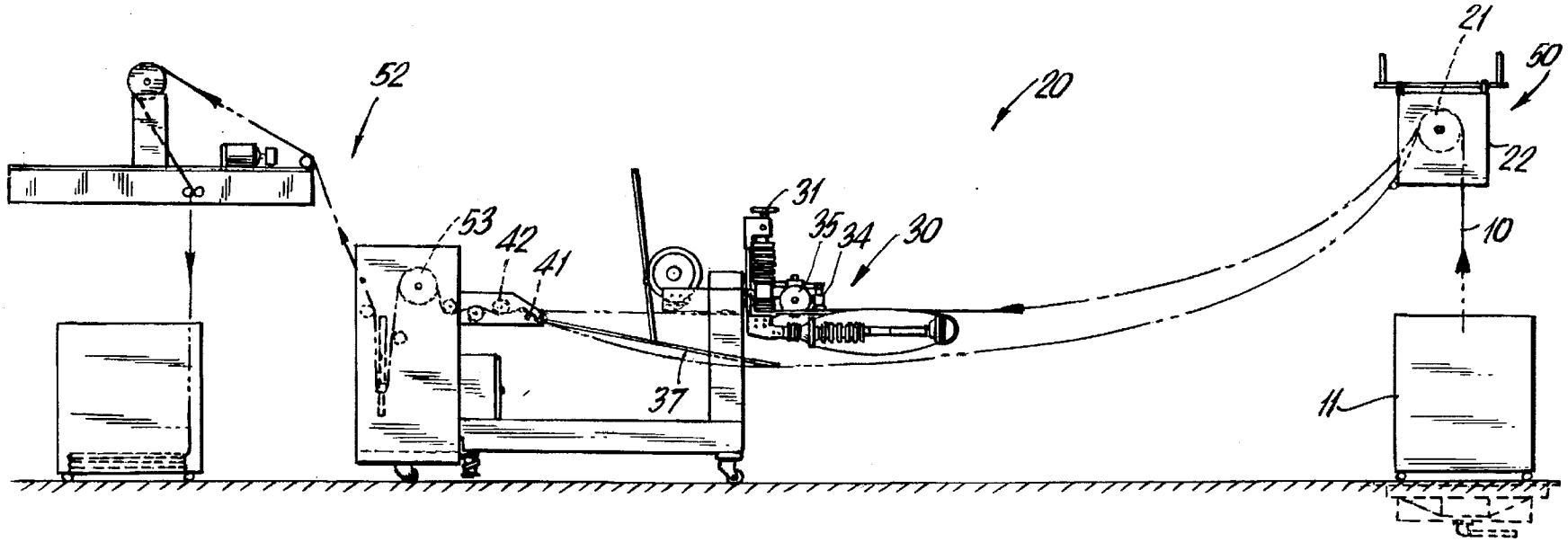
FIG. 1 is a side elevation of the apparatus incorporating the principles of the present invention.

As shown in FIG. 1 knit tubular fabric 10 is delivered via a transport truck 11 to the apparatus, generally designated 20, and is moved out of the truck 11 by a well known dancer controlled lift roll 21 shown schematically in FIG. 1. The roll 21, through the housing 22, may be mounted on the ceiling or any appropriate location. Tubular knit fabric 10 is fed over the cage 30 which may be opened to slightly less then the diameter of the knit tube. This may be accomplished through the manipulation of the wheel 31 connected to the plural supports 33 of the cage through an arrangement of gears and screws as shown in U.S. Pat. No. 3,864,794. This opening and setting of the supports may also be accomplished by any automatic system which is also well known in the art.

A sensing unit 34 is also disposed in close association with the cage and a cutting knife 35. In this fashion and because the knit tube is draped over the cage 30 it becomes unnecessary to expand the cage to open the fabric fully to the diameter of the knit tube. It is only necessary to keep the fabric flat and free of wrinkles and I have found that this is accomplished by the concept I have disclosed herein. The result is a fabric that is cut quickly and efficiently and without the yarn tension described above.

Figure 2:
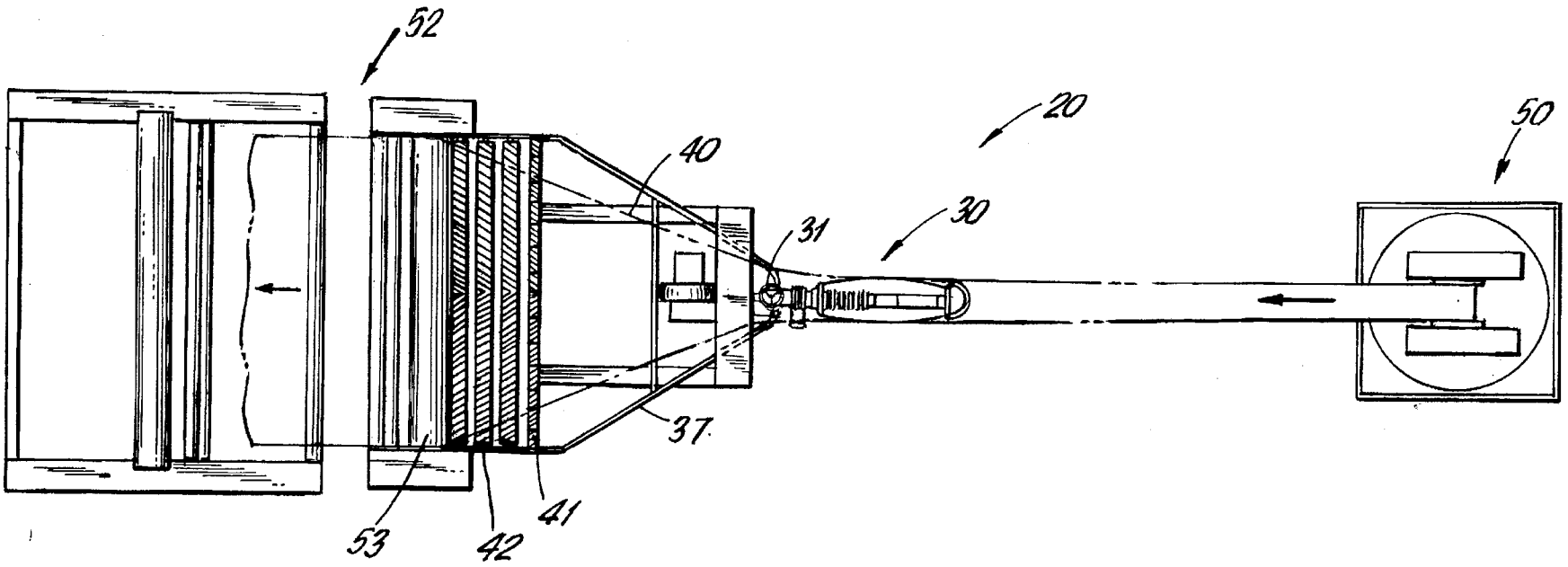
FIG. 2 is a top view of the apparatus shown in FIG. 1.
Figure 3:
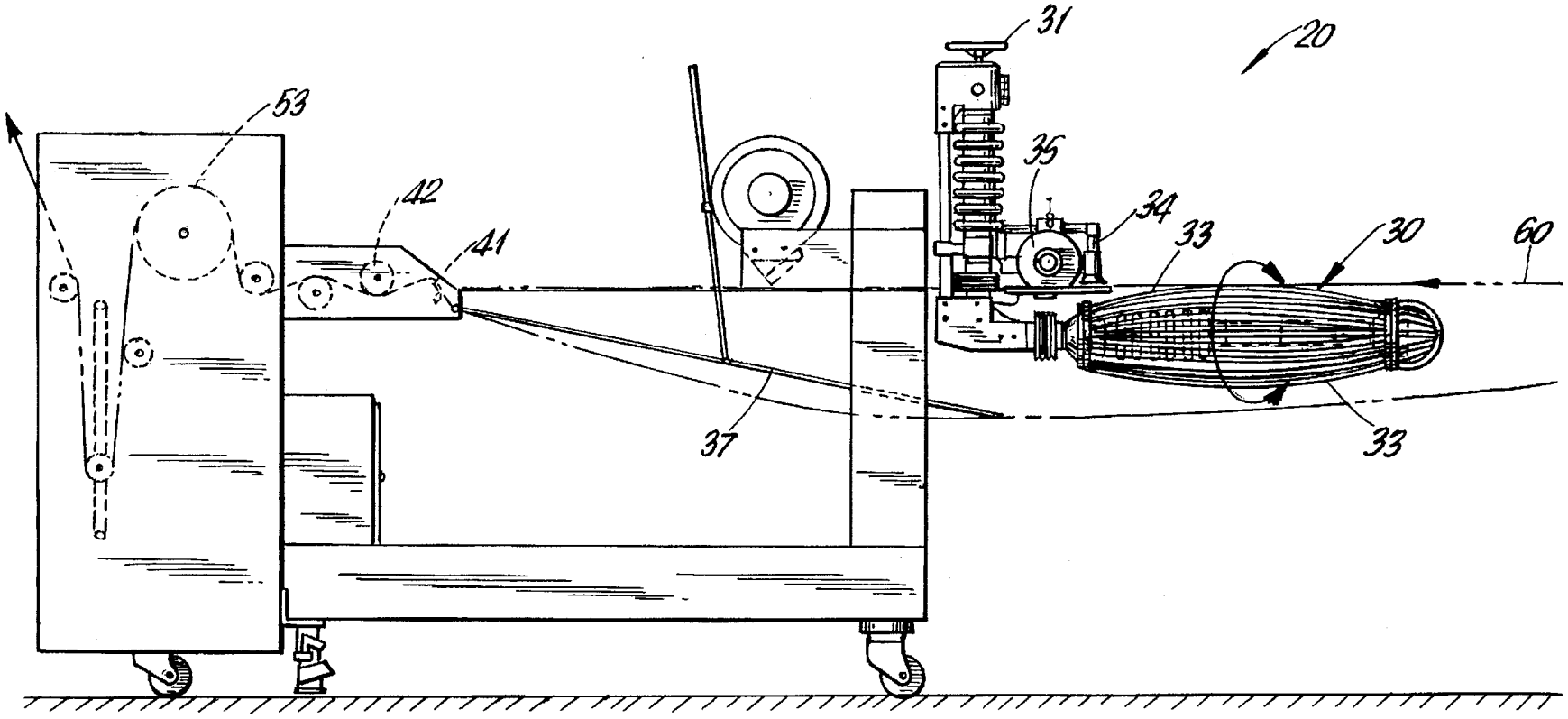
FIG. 3 is a partial enlarged view of the apparatus showing in particular the slitter and cage portions and the sections of the apparatus which operate to open and flatten the fabric.

After cutting of the knit fabric tube 10 the fabric continues moving past a wire spreader 37 which functions to open the fabric to a flat state as shown in FIG. 2 and designated 40. The fabric continues over a system of spreaders and bars to further spread same to achieve a fabric that is flat and free of wrinkles. This may be accomplished through the use of a herringbone bar 41 and rotating scroll rolls 42.

Any type of conveyer device may be used to move the fabric from its entry in tubular knit form at one end 50 through the unit and out at the other end 52. One such device is shown as the dancer roll 21 and also the draw roll 53 may be included for this purpose. The open and wrinkle free fabric may then be moved to another work area for processing as desired.

One important feature of this concept is that the fabric be moved along a horizontal axis 60 starting at its entry on the cage 30 and continue along this axis as the fabric moves along the cage, the sensing means 34 and the knife 35. The fabric continues along this horizontal axis 60 in its path through the spreader 37, and rolls 41 and 42. In this manner the maximum reduction in yam tension is realized without appreciably reducing the slitting speed.

What is claimed as new and desired to be protected is set forth in the appended claims.

I claim:

1. An apparatus for opening a tube of knit fabric comprising a) a slitter means for opening the knit tube;

b) a conveying unit for said apparatus for moving the knit tube along a horizontal axis;

c) a guide means on the fabric;

d) sensing means associated with the slitter means to follow the guide means on the fabric so that the slitter means operates to cut the knit tube of fabric so that same is opened and laid flat;

e) a conveyor device on the apparatus for moving the knit tube of fabric on a horizontal axis;

f) means for opening the knit tube of fabric on said apparatus including an expandable member which operates to open the tubular knit fabric without appreciably tensioning and elongating the tubular knit fabric and prior to slitting same;

g) said expandable member comprising a plurality of supports about an axially disposed member and said sensing means and slitter being part of said expandable member;

h) means for said apparatus including a member for opening the fabric so that it is essentially free of wrinkles; and i) means for said apparatus including a device for maintaining the opened fabric in a flat state.

2. The apparatus of claim 1 wherein the guide means on the fabric moves along a horizontal axis from its entry into the apparatus through its exit therefrom.

3. The apparatus of claim 1 wherein the expandable member is opened to a lesser dimension then the diameter of the knit tube of fabric.

4. The apparatus of claim 1 wherein the knit tube of fabric is only opened to the degree so that the fabric drapes over the expandable member.

5. An apparatus for opening a tube of knit fabric comprising a) a slitter means for opening the knit tube;

b) a conveying unit for said apparatus for moving the knit tube along a horizontal axis;

c) a guide means for the fabric;

d) sensing means associated with the slitter means; said guide means on the knit fabric tube to serve as a guide for the sensing means to actuate the slitter means to cut the knit fabric tube whereby the fabric tube may be opened and laid flat so that the vertical wales form right angles with the courses of the knit fabric tube to approximate a woven fabric;

e) a conveyor device on the apparatus for moving the knit tube of fabric on a horizontal axis;

f) means for opening the knit tube of fabric on said apparatus including an expandable member which operates to open the tubular knit fabric with out appreciably tensioning and elongating the tubular knit fabric and prior to slitting same;

g) said expandable member comprising a plurality of supports about an axially disposed member and said sensing means and slitter being a part of said expandable member;

h) means for said apparatus including a member for opening the fabric so that it is essentially free of wrinkles; and i) means for said apparatus including a device for maintaining the opened fabric in a flat state.

6. The apparatus of claim 5, wherein the guide means on the knit fabric tube moves along a horizontal axis from its entry into the apparatus through its exit therefrom.

7. The apparatus of claim 6, wherein the expandable member is opened to a lesser dimension then the diameter of the knit tube of fabric.

8. The apparatus of claim 6, wherein the knit tube of fabric is only opened to the degree so that the fabric drapes over the expandable member.

* * * * *